US009642430B1

(12) United States Patent
Carbajal

(10) Patent No.: US 9,642,430 B1
(45) Date of Patent: May 9, 2017

(54) MOTION-SENSING ILLUMINATING SYSTEM WITH SOLAR CHARGING CAPACITY FOR HAND BAG OR PURSE

(71) Applicant: Juan N. Carbajal, Sierra Vista, AZ (US)

(72) Inventor: Juan N. Carbajal, Sierra Vista, AZ (US)

( * ) Notice: Subject to any disclaimer, the term of this patent is extended or adjusted under 35 U.S.C. 154(b) by 11 days.

(21) Appl. No.: 14/815,719

(22) Filed: Jul. 31, 2015

Related U.S. Application Data

(60) Provisional application No. 62/057,230, filed on Sep. 29, 2014.

(51) Int. Cl.

| | |
|---|---|
| ***A45C 15/06*** | (2006.01) |
| ***F21V 33/00*** | (2006.01) |
| ***F21V 23/04*** | (2006.01) |
| ***F21L 4/08*** | (2006.01) |
| *F21W 111/10* | (2006.01) |

(52) U.S. Cl.
CPC ..... *A45C 15/06* (2013.01); *F21L 4/08* (2013.01); *F21V 23/0471* (2013.01); *F21V 33/0008* (2013.01); *F21W 2111/10* (2013.01)

(58) Field of Classification Search
CPC ..... A45C 15/06; F21V 33/0008
USPC ..... 362/156
See application file for complete search history.

(56) References Cited

U.S. PATENT DOCUMENTS

| | | | | |
|---|---|---|---|---|
| 9,568,183 | B2 * | 2/2017 | Voskanian | A45C 15/06 |
| 2013/0021786 | A1 * | 1/2013 | Noble | A45C 15/06 362/156 |
| 2015/0022099 | A1 * | 1/2015 | Farley | H05B 33/0857 315/161 |

FOREIGN PATENT DOCUMENTS

| | | | | |
|---|---|---|---|---|
| DE | 102008026571 | * | 12/2009 | A45C 15/06 |

* cited by examiner

*Primary Examiner* — Anh Mai
*Assistant Examiner* — Michael Chiang

(57) ABSTRACT

A solar powered motion sensing system that is integrated into a purse or other handbag including but not limited to a piece of luggage, a clutch purse, or the like. The solar powered motion sensing system activates a light upon detection of a hand or other motion entering the handbag.

1 Claim, 3 Drawing Sheets

100

MOTION-SENSING ILLUMINATING SYSTEM WITH SOLAR CHARGING CAPACITY FOR HAND BAG OR PURSE

CROSS REFERENCE

This application claims priority to U.S. Provisional Patent Application No. 62/057,230 filed Sep. 29, 2014, the specification of which is incorporated herein in its entirety by reference.

FIELD OF THE INVENTION

The present invention relates to motion sensing systems that activate lights or other alerting mechanisms, more particularly to a solar powered motion sensing system integrated into a purse or other handbag wherein the motion sensing system activates a light upon detection of a hand entering the hand bag.

BACKGROUND OF THE INVENTION

The present invention features a solar powered motion sensing system that is integrated into a purse or other handbag. The motion sensing system activates a light upon detection of a hand entering the handbag. The present invention is not limited to a purse or other small handbag. The motion sensing system may be integrated into any appropriate piece of luggage or bag such as but not limited to a suitcase, a clutch purse, or the like.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a motion sensing system for a purse or other piece of luggage. In some embodiments, the motion sensing system comprises a bag; a motion sensor disposed inside the bag in a position in the bag so as to detect motion inside the bag, the motion sensor is coupled to a timing circuit; a light source operatively connected to the motion sensor and timing circuit; a power source operatively connected to a solar cell, the solar cell is adapted to recharge the power source when the solar cell is exposed to direct sunlight or ambient light, the power source is further operatively connected to the light source, the motion sensor, and the timing circuit; and a switch operatively connected to the power source, the switch is adapted to turn the system on and off. The motion sensing system activates the light source upon detection of motion inside the bag, and the timing circuit controls how long the light source remains illuminated.

In some embodiments, the system comprises one light source, two light sources, three light sources, or more than three light sources. In some embodiments, at least one component of the system comprises Surface-Mount Technology (SMT).

DESCRIPTION OF PREFERRED EMBODIMENTS

Figure 1:
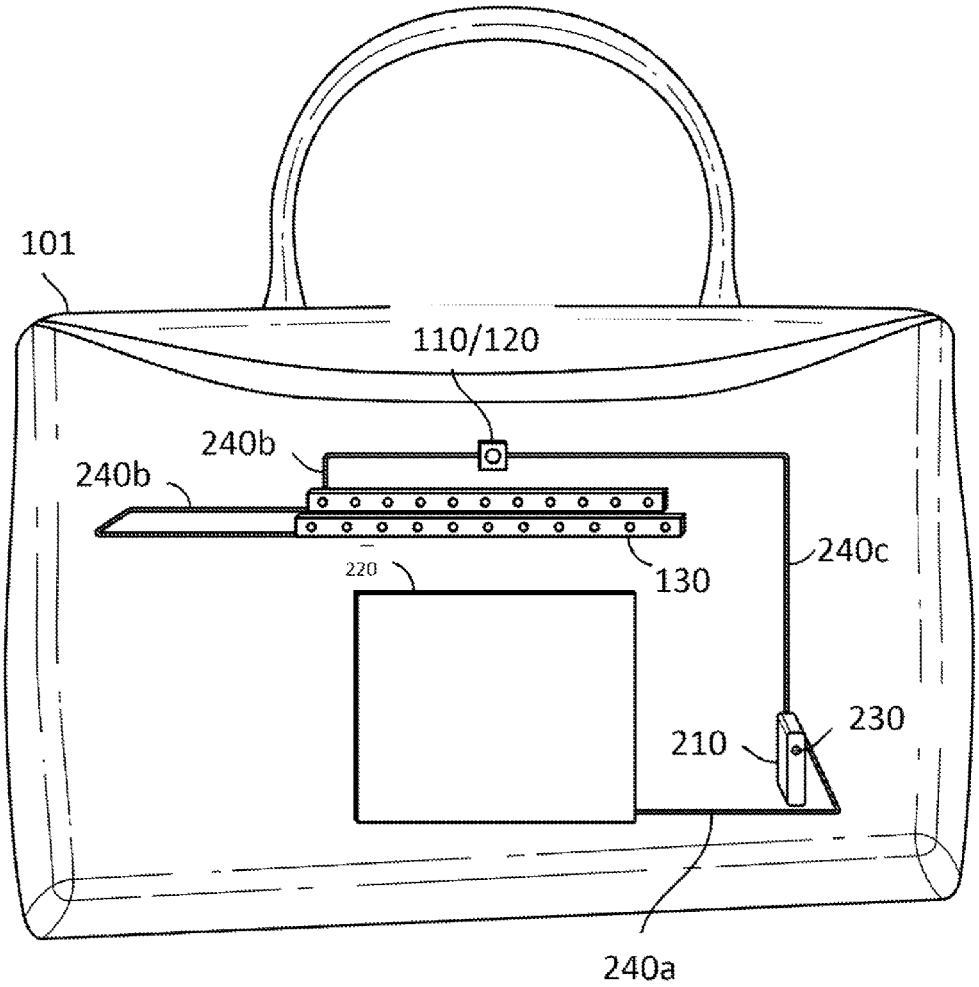
FIG. 1 shows a front view of the motion sensing illuminating system of the present invention integrated into a purse.

Following is a list of elements corresponding to a particular element referred to herein:

100 motion sensing illuminating system
101 purse or other piece of luggage or bag
110 motion sensor
120 timing circuit
130 light source
210 power source
220 solar cell
230 switch (e.g., vacation/safety switch)
240*a* solar panel to power source connecting wire
240*b* motion sensing/timer apparatus to light source connecting wire
240*c* switch to motion sensing/timer apparatus connecting wire In a typical embodiment, the invention is a motion sensing system (100) comprising a bag (101), a motion sensor and timing circuit (110/120), a light source (130) connected in series to the motion sensor and timing circuit, a power source (210), wherein the power source (210) is connected to supply power to the light source (130), the motion sensor (110), and the timing circuit (120), wherein the power source is connected in series to the light source and the switch of the motion sensor and timing circuit, and a second switch (230), connected in series between the power source (210) and the motion sensor and timing circuit, such that when the second switch is closed the second switch (230) turns the system (100) on, and when the second switch is opened the second switch turns the system off. In a typical embodiment, the power source is operatively connected to a solar cell (220), and the solar cell (220) is adapted to recharge the power source (210) when the solar cell (220) is exposed to direct sunlight or ambient light.

The motion sensor and timing circuit comprises a motion sensor (110), a timing circuit (120), operatively connected to the motion sensor, configured to start a timer when the motion sensor is activated, and a first switch (115), operatively connected to the motion sensor (110) and timing circuit (120). The motion sensor is disposed inside the bag (101) in a position in the bag (101) so as to detect motion inside the bag (101), whereupon the motion sensor activates the timing circuit (120) and closes the first switch (115), wherein the timer circuit (120) is configured to open the first switch (115) after a delay period after the timer is activated.

In a typical embodiment, the motion sensor (110) upon detection of motion inside the bag (101), activates the timing circuit (120), and closes the first switch (115), which turns on the light source (130), whereupon when the timing circuit (120) expires the timer circuit opens the first switch (115), which turns off the light source (130).

In varying embodiments, the system (100) comprises one light source, two light sources, three light sources, or more than three light sources.

In some embodiments, at least one component of the system (100) is constructed using Surface-Mount Technology (SMT).

Figure 2:
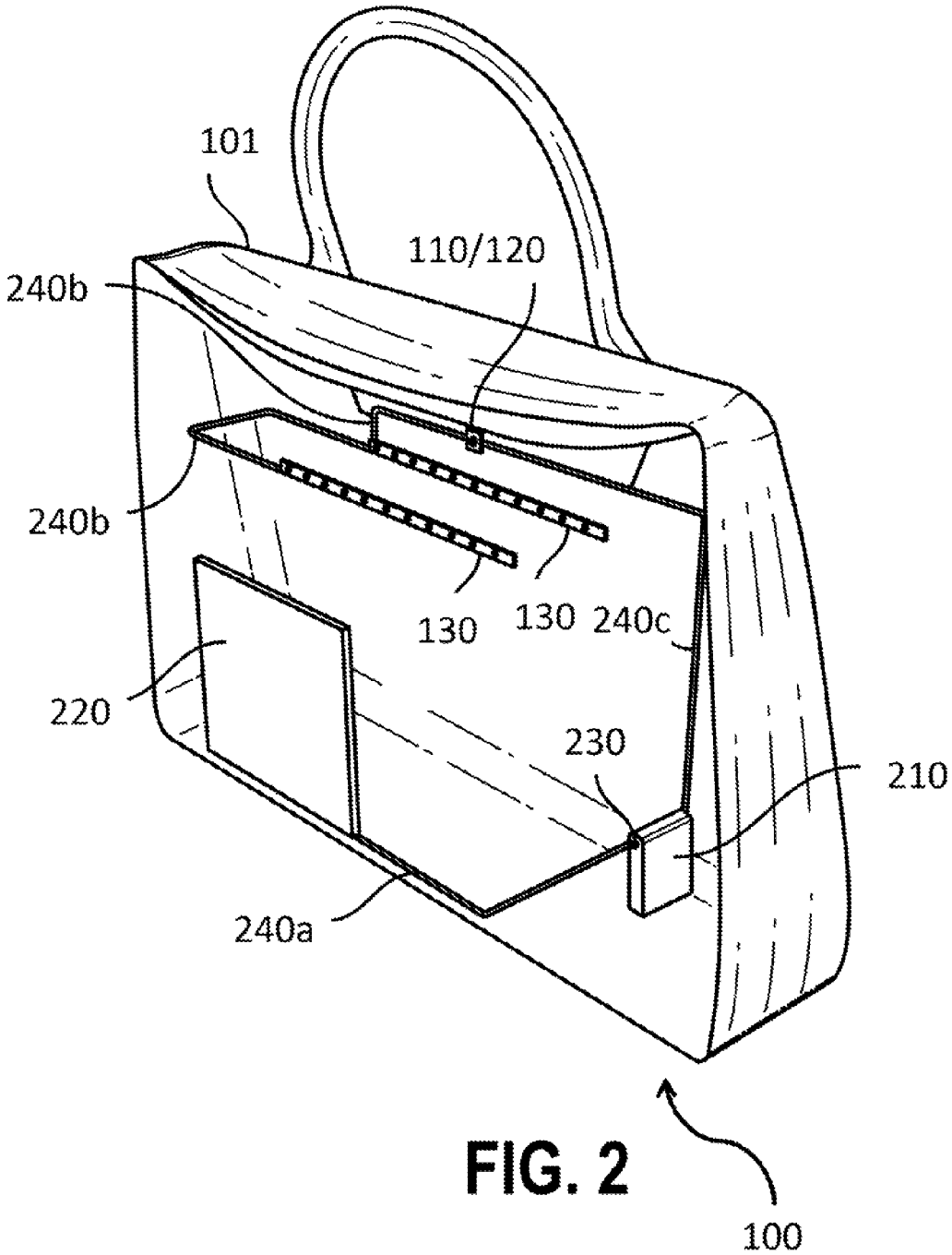
FIG. 2 shows a perspective view of the system of FIG. 1.
Figure 3:
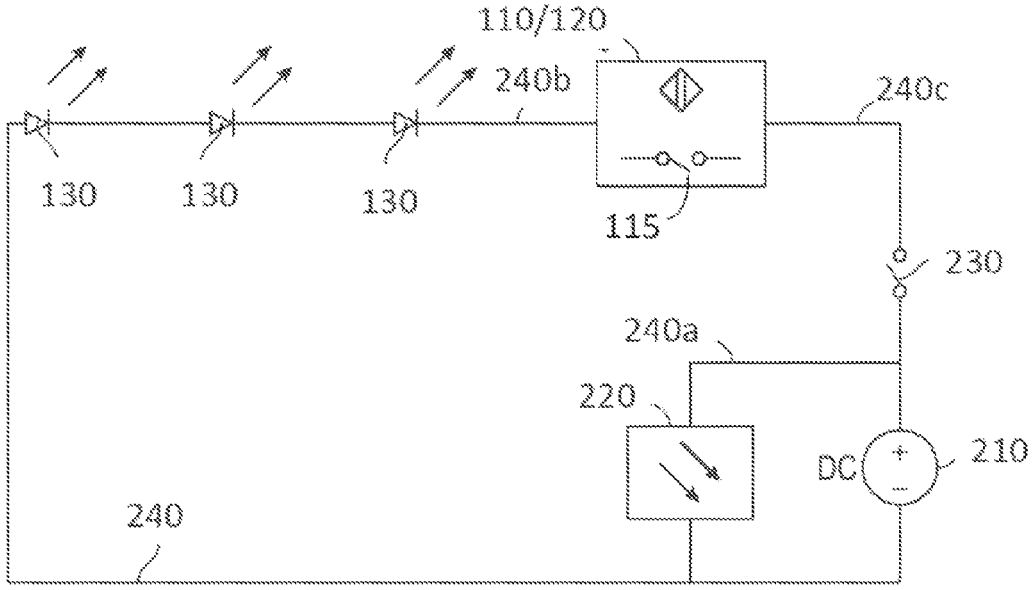
FIG. 3 shows a schematic representation of various electrical components of the system of the present invention.

Referring now to FIG. 1-3, the present invention features a motion sensing system (100) for a purse (101) or other piece of luggage (e.g., handbag, clutch purse, suitcase, etc.). The motion sensing system activates a light upon detection of a hand entering the handbag. In some embodiments, the motion sensing system (100) comprises the purse (101) (or other piece of luggage). In some embodiments, the motion sensing system (100) is independent of the purse (101) (or other piece of luggage). The motion sensing system (100) may be installed in any appropriate place in the purse (101) (or other piece of luggage), e.g., the interior, the interior of the bag at or near the bottom of the bag, etc.

The motion sensing system (100) comprises a motion sensor (110). The motion sensor (110) is coupled to a timing circuit (120). The motion sensor (110) and/or timing circuit (120) is operatively connected to a light source (130) (e.g., one light source, two light sources three light sources, more than three light sources, etc.). The motion sensor (110) is adapted to activate (illuminate) the light source (130). The timing circuit (120) controls how long the light source (130) is illuminated.

The motion sensing system (100) comprises a power source (210) (e.g., battery or other appropriate power source) operatively connected to a solar cell (220). The power source (210) is operatively connected to the light source (130), the motion sensor (110) and timing circuit (120). The power source (210) is adapted to be recharged via the solar cell (220), e.g., when exposed directly to ambient or sun light.

As shown in FIG. 3, various electrical components are connected via connecting wires, e.g., a first connecting wire (240*a*) connects the solar cell (220) to the power source (210), a second connecting wire (240*b*) connects the motion sensor (110)/timing circuit (120) to the light source (130), a third connecting wire (240*c*) connects the motion sensor (110)/timing circuit (120) to the switch (230).

In other embodiments, the present invention features a motion-activated lighting system (100) for a bag (100). The system (100) may comprise the bag (101) having an exterior bag surface and a bag opening fluidly connected to an interior bag compartment, a motion detector disposed in the interior bag compartment, at least one light source (130), a power source operatively connected to a solar cell (220), and a second switch (230).

In some embodiments, the motion detector comprises a motion sensor (110) positioned near the bag opening so as to detect motion inside the bag (101), a timing circuit (120) operatively connected to the motion sensor (110), and a first switch (115) operatively connected to the motion sensor (110) and timing circuit (120). The timing circuit (120) may be configured to start a timer when the motion sensor (110) is activated. In some embodiments, the motion sensor (110) is configured to close the first switch (115) when the motion sensor (110) is activated. Preferably, the first switch (115) remains closed when motion is being detected. When no motion is detected, the first switch (115) is closed for a delay period after the timer is activated, and the timer circuit (120) is configured to open the first switch (115) after the delay period expires.

In some embodiments, the light source (130) is disposed in the interior bag compartment to light inside the bag (101). The light source (130) may operatively connected in series to the first switch (115) of the motion detector. In one embodiment, the system may comprise one or more light sources, such as 1-4 light sources. In another embodiment, the light source (130) is disposed at or near the bag opening or base of the bag. In still another embodiment, the light source (130) is spans from one side to an opposing side of the bag. For example, the system may comprise two light sources that disposed near the bag opening and are parallel to each other.

In some embodiments, the power source (210) is disposed near a base of the bag. In other embodiments, the power source is operatively connected to a solar cell (220) disposed on a portion of the exterior bag surface. For example, the solar cell (220) may be positioned on the exterior bag surface such that the solar cell (220) is unobstructed from direct sunlight or ambient light. Preferably, the solar cell (220) is adapted to recharge the power source (210) when the solar cell (220) is exposed to direct sunlight or ambient light. The power source (210) can supply power to the light source (130), the motion sensor (110), and the timing circuit (120). In some embodiments, the power source (210) is operatively connected in series to the light source (130) and the first switch (115).

In other embodiments, the second switch (230) is operatively connected in series between the power source (210) and the motion detector. When the second switch (230) is closed, the second switch (230) turns the system (100) on, and when the second switch (230) is opened, the second switch (230) turns the system off.

In some embodiments, the motion sensor (110) upon detection of motion inside the bag (101), activates the timing circuit (120) and closes the first switch (115), which turns on the light source (130). When no motion is detected in the bag (101), the timer circuit opens the first switch (115) after the delay period expires and the light source (130) is turned off.

In some embodiments, some or all of the electrical components of the system (100) of any embodiment of the present invention are of the Surface-Mount Technology (SMT) nature. Without wishing to limit the present invention to any theory or mechanism, it is to maintain efficiency, to keep the weight and size factors to a minimum, and remain discretely concealed from plain sight, furthermore becoming unobtrusive to the user.

Example 1—Motion-Sensing Illuminating System for Purse

Example 1 describes a system (100) of the present invention integrated into a purse (101). The present invention is not limited to the configurations or components described in Example 1. As shown in FIG. 1 and FIG. 2, the power source (210) is discretely hidden on the bottom of the purse. Operatively connected to the power source (210) is a switch (230) (e.g., safety/vacation switch). The power source (210) is operatively connected to a solar cell (220) via a connecting wire, e.g., a first connecting wire (240*a*), on one end and to the switch (230) and further to the motion sensor (110)/timer device (120) by means of another connecting wire (240). The light source (130) is operatively connected to the output of the motion sensor/timing circuit (110, 120) by means of a connecting wire (240). The solar panel (220) is mounted on the purse (101), e.g., on the front of the purse (101).

The motion sensor (110) is adapted to detect a hand (e.g., the user's hand) as it enters the purse (101), thereby activating the light source(s) (130) for a determined amount of time (based on the timing circuit (120)). After the user has removed his/her hand, the light source (130) will remain on, e.g., for just a few more seconds. Then the light source (130) will extinguish (e.g., eliminating the need for a switch, further more a discharged power source).

The power source (210) will be recharged by a solar cell (220), which may be mounted at the front of the purse (101) or any other appropriate place on the purse (101). The switch (230) is an extra safety device for turning the system (100) off when the purse (101) is not being used, e.g., for long periods of time.

The light sources (130) can be mounted in any appropriate manner. For example, in some embodiments the light sources (130) are mounted horizontally, vertically, or even at the bottom of the bag or luggage piece according to the needs of such item.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A motion-activated lighting system for a bag consisting of:

a. the bag consisting of an exterior bag surface, an interior bag compartment, a bag opening fluidly connected to the interior bag compartment, and a base;

b. a motion detector disposed in the interior bag compartment and positioned immediately adjacent to the bag opening, said motion detector consisting of:

i. a motion sensor positioned near the bag opening so as to detect movement as it enters from the bag opening;

ii. a timing circuit operatively connected to the motion sensor, wherein the timing circuit is configured to start a timer when the motion sensor is activated; and iii. a first switch operatively connected to the motion sensor and timing circuit, wherein the motion sensor is activated when the motion sensor detects movement as it enters from the bag opening, wherein the motion sensor is configured to close the first switch when the motion sensor is activated, wherein the first switch is closed when motion is being detected, wherein when no motion is detected, the first switch is closed for a delay period after the timer is activated, and the timer circuit is configured to open the first switch after the delay period expires;

c. a light source disposed in the interior bag compartment, the light source providing light inside the bag, wherein the light source is operatively connected in series to the first switch of the motion detector, the light source is disposed below the motion sensor, the light source lines two opposing sides of the bag;

d. a solar cell disposed on a portion of the exterior bag surface, wherein the solar cell is positioned on the exterior bag surface such that the solar cell is unobstructed from direct sunlight or ambient light;

e. a power source disposed near the base of the bag, wherein the power source is operatively connected to the solar cell, wherein the solar cell is adapted to recharge the power source when the solar cell is exposed to direct sunlight or ambient light, wherein the power source supplies power to the light source, the motion sensor, and the timing circuit, wherein the power source is operatively connected in series to the light source and the first switch; and f. a second switch operatively connected in series between the power source and the motion detector, wherein when the second switch is closed, the second switch turns the system on, and when the second switch is opened, the second switch turns the system off;

wherein the motion sensor upon detection of movement as it enters from the bag opening, activates the timing circuit and closes the first switch, which turns on the light source, wherein when no motion is detected in the bag, the timer circuit opens the first switch after the delay period expires and the light source is turned off, wherein the motion-activated lighting system provides light inside the bag.

* * * * *